United States Patent [19]

Körner

[11] Patent Number: 5,072,232

[45] Date of Patent: Dec. 10, 1991

[54] END-FED ROD ANTENNA

[75] Inventor: Wolfgang Körner, Ehingen, Fed. Rep. of Germany

[73] Assignee: Telefunken Systemtechnik GmbH, Ulm, Fed. Rep. of Germany

[21] Appl. No.: 564,021

[22] Filed: Aug. 7, 1990

[30] Foreign Application Priority Data

Aug. 22, 1989 [DE] Fed. Rep. of Germany ..... 3927665

[51] Int. Cl.[5] ..... H01Q 9/32; H01Q 21/30

[52] U.S. Cl. ..... 343/729; 343/790; 343/826; 343/893; 343/701; 455/293

[58] Field of Search ..... 343/701, 790, 791, 729, 343/826, 893; 455/293, 291

[56] References Cited

U.S. PATENT DOCUMENTS

| | | | |
|---|---|---|---|
| 3,521,169 | 7/1970 | Turner et al. | 343/701 |
| 3,523,251 | 8/1970 | Halstead | 343/701 |
| 3,622,890 | 11/1971 | Fujimoto et al. | 343/701 |

*Primary Examiner*—Michael C. Wimer

*Attorney, Agent, or Firm*—McGlew & Tuttle

[57] ABSTRACT

The present invention pertains to an end-fed rod antenna which is tuned, e.g., to the VHF range and has additional transmitting and/or receiving antennas for the mm-wave range.

11 Claims, 1 Drawing Sheet

END-FED ROD ANTENNA

FIELD OF THE INVENTION

The present invention relates in general to an antenna for transmitting and receiving electromagnetic waves and in particular to a new and useful antenna able to transmit and receive widely separated frequencies.

BACKGROUND OF THE INVENTION

Such antennas can be used in many different ways, especially for mobile radios. The transmitting and/or receiving stations are designed as mobile units and may be installed, e.g., on or in an automobile. A rod antenna is particularly well suited for such applications.

It is often desirable to transmit and/or receive in a plurality of wavelength ranges. In general, different antennas, which are mounted on a separate mast, are required for this purpose. Especially in mobile radio, such arrangements are disadvantageously uneconomical, susceptible to malfunction, and require much time for maintenance. It is often necessary to operate essentially simultaneously in two greatly different wavelength ranges, e.g., the meter range and the millimeter range. The longer wavelength, here the meter range, is needed for communication over greater distances, while the shorter wavelength is used for communication over shorter distances only. The millimeter range is particularly well suited for the latter, because it has quasioptical propagation properties. The abbreviation mm waves will also be used for millimeter waves below.

THE SUMMARY OF THE INVENTION

The basic task of the present invention is to provide a rod antenna of the class specified, which is suitable for a plurality of wavelength ranges, one of which is the millimeter range.

The antenna is an end-fed rod with an inner wave guide and an outer coaxial wave guide. At the tip of the antenna, opposite the feed end, is a millimeter-wave transmitter antenna and spaced along the upper half are millimeter-wave receiving antennas. Millimeter waves are fed at the base of the antenna into the inner wave guide, and then sent to the millimeter-wave transmitter antenna at the tip end for broadcasting. Millimeter-waves received by the receiving antennas are converted to IF-frequencies and sent down the outer coaxial wave guide. The metalized surface of the outer wave guide can also be used as an antenna for much larger meter range wave lengths.

The first advantage of the present invention is the fact that a plurality of different communications, e.g., voice communication and/or data transmission, are simultaneously possible in the millimeter range over short distances, i.e., the range of quasioptical distances, without mutual disturbances, e.g., undesired interferences.

Another advantage is the fact that highly safe, i.e., interception-proof communication is possible.

A third advantage is the fact that the rod antenna is essentially position-independent even for the millimeter wave range. Therefore, the communication is not interfered with, e.g., by wind effects and/or movements of the mobile transmitting and/or receiving station.

A fourth advantage is the fact that diverse reception is possible in the millimeter range, as a result of which communication becomes substantially more reliale.

A fifth advantage is the fact that the mm-wave transmitting antenna and the mm-wave transmitter are spatially separated. This makes possible a mm-wave transmitter, currently with efficiencies of only approximately 10%, at the base of the rod antenna, and creating good cooling possibilities for removing heat from energy losses can be created. The mm-wave sending antenna is arranged at the tip of the rod antenna. This arrangement makes it possible to obtain a lightweight and flexible rod antenna which has a high transmission power in the mm-wave range.

A further object of the invention is to provide an antenna suitable for transmitting and receiving on a plurality of wave lengths which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
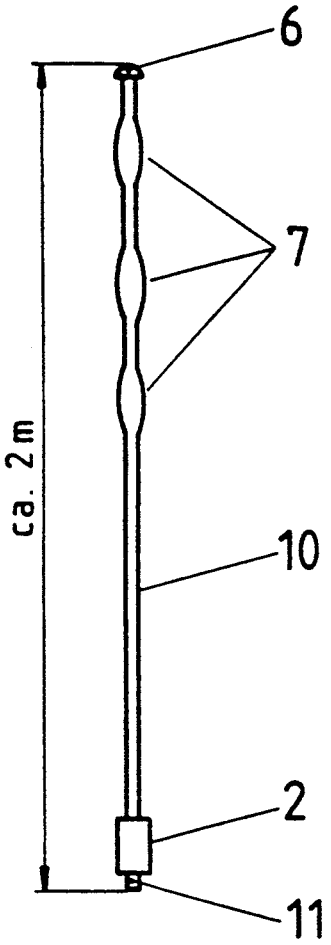
FIG. 1 is a the synoptic view of a rod antenna, which as a transmitting and receiving antenna is equally suitable for the VHF range and the mm-wave range.

FIG. 1 shows an outer tube 10, which has an electrically conductive outer surface and whose length is adjusted to the wavelength range with the greater wavelength. The length equals, e.g., approximately 2 m for the VHF range, selected as an example. The outer tube 10 consists, e.g., of a plastic tube with an external diameter of approximately 18 mm and a wall thickness of approximately 1.5 mm. The outer surface had been rendered electrically conductive by a currentless chemical metallization process. At one end of the outer tube 10, or at the tip of the rod antenna, a mm-wave transmitting antenna 6 for the mm-wave range is located. Reference numeral 7 designates mm-wave receiving systems each consisting of at least a mm-wave receiving antenna 14, a mm-wave receiving mixer 15 and an IF-amplifier 16, which are located in the upper zone of the rod antenna, possibly, at a distance of approximately 0.3 m from the mm-wave transmitting antenna 6 and from each other. The three receiving systems 7 represented as an example make the diverse operation in the mm-wave range possible. At the other end of the outer tube 10, or the base of the rod antenna, a housing 2 is located, which contains transmitter-receiver electronic assemblies and/or components, namely 1, 3, 4 and 9 for operating the rod antenna. According to FIG. 2, the housing 2 contains, e.g., an $H_{01}$ mm-wave transmitter 1, a local oscillator (LO) means 4 for mm waves, a coupling circuit 3, as well as a diversity receiver 9. A connection 11, e.g., a metal flange with a plug, serves to mechanically fasten the rod antenna on an antenna base (not shown).

Figure 2:
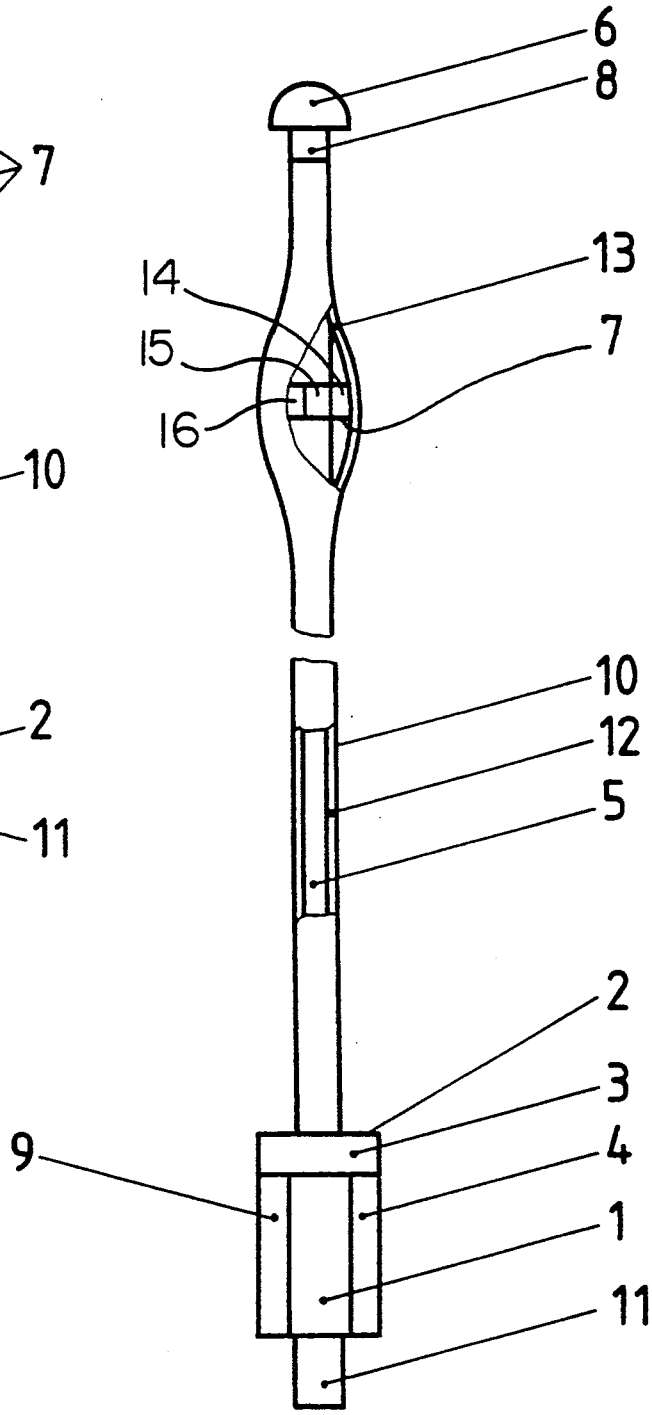
FIG. 2 is an enlarged detail of the arrangement according to FIG. 1.

According to FIG. 2, the mm-wave transmitter 1, which is connected to a modulator (not shown), e.g., via the connection 11, generates a modulated $H_{01}$ mm-wave corresponding to the communication to be transmitted. The wave is fed into an $H_{01}$ circular waveguide 5 via the coupling circuit 3. This circular waveguide consists of an inner tube 12, e.g., a plastic tube, which has an internal diameter of approximately 10 mm and a wall thickness of approximately 1 mm. The internal surface of the plastic tube is electrically conductive, e.g., due to currentless chemical metallization, as a result of which the circular waveguide 5 is formed. The circular waveguide 5 advantageously has very low attenuation, e.g., 0.3 dB/m, so that practically lossless power transmission to the transmitting antenna 6 at the top of the rod antenna is possible. The local oscillator means 4 contains an independent oscillator and other normally required support components for producing a varying electrical signal at a mixer frequency. This mixer frequency electrical signal is sent to the coupling circuit 3 which transforms the mixer frequency electrical signal into an $H_{11}$ wave. The coupling circuit 3 then couples the modulated $H_{01}$ mm-wave with the $H_{11}$ wave and transmits these now coupled waves through the circular wave guide 5. The $H_{11}$ wave portion of this coupled wave is received by the receivers which are directly coupled to the mm-wave receiving antennas in the receiving systems 7. The circular waveguide 5 has an attenuation of approximately 2–3 dB/m for the $H_{11}$ wave. This attenuation, which is high in itself, is not disturbing, because only low power is needed for mixing in the mm-wave receiving mixer 15. The $H_{01}$ wave is converted by means of a moding section 8, which is located directly at the transmitting antenna 6, and an $H_{11}$ wave band-rejection filter located there. The moding section 8 converts the $H_{01}$ wave into a circularly polarized wave, which is broadcast by the transmitting antenna 6 over an azimuth angle of approximately 360° and an angle of elevation of approximately 135°.

This nondirectional transmission guarantees that all neighboring vehicles and even flying receiving and/or transmitting stations can be reached regardless of the bending of the rod antenna and the inclination of the vehicle on which the rod antenna is mounted.

For example, 2 or 3 of the mm-wave-receiving systems 7, which permit antenna diversity reception (space diversity), are arranged at the upper end of the rod antenna.

The distance between the topmost receiving system 7 and the mm-wave transmitting antenna 6 equals, e.g., 0.3 m. The receiving systems 7 are also spaced at approximately 0.3 m from each other. The receiving systems 7 have a range of reception of 360° in the azimuth and approximately 135° in elevation. The range of reception for each receiving system 7 can also be advantageously subdivided into individual reception sectors with each reception section having a smaller angle range. Interfering multiple reflections of an arriving $H_{01}$ wave, which may be present and arriving in different directions, can therefore be ignored. In the area of a receiving system 7, the $H_{11}$ wave (mixer frequency) being guided in the circular waveguide 5 is coupled out via a slot located in the circular waveguide 5 and is fed into the receiving mixer 15. The mm-wave receiving antenna 14 of the receiving system 7, receives mm-waves from the surrounding environment. This mm-wave receiving antenna 14 can be designed, for example, as a microstrip antenna extending outside the outer tube 10. Mm-waves received by the mm-wave receiving antenna 14 are fed into the receiving mixer 15 along with the $H_{11}$ wave from the circular wave guide 5. The receiving mixer then combines the received mm-waves from the environment and the $H_{11}$ waves to form an intermediate frequency. In addition, a first intermediate frequency amplifier 16 (IF amplifier), which is preferably designed as a monolithically integrated component, is coupled to the receiving mixer 15. The output signal generated by the first IF amplifier is sent to a second IF amplifier, which is also arranged in the area of a receiving system 7.

The output signals generated by the second IF amplifiers are synchronized with the LO and have a fixed (carrier) frequency, which is below that of the rod antenna, i.e., below the VHF frequency in this case. The output signals of the second IF amplifiers are coupled into the coaxial conductor, which is formed by the metal coatings of the circular waveguide 5 and of the outer tube 10, transmitted to the coupling circuit 3, and conducted from there into the diversity receiver 9 for further evaluation. In addition, the power supply for the active assemblies (mixer, IF amplifiers, etc.) belonging to each receiving system 7 is also ensured via the coaxial conductor. Each receiving system 7 is protected from interfering ambient effects by a radome 13.

While a specific embodiment of the invention has been shown and described in detail to illustrate the application of the principles of the invention, it will be understood that the invention may be embodied otherwise without departing from such principles.

What is claimed is:

1. An end-fed antenna for a plurality of wave length ranges, at least one of which is in the millimeter range, the antenna comprising:
   - a millimeter range wave guide;
   - an electrically conductive outer tube positioned around said wave guide and forming a coaxial conductor with said wave guide.
   - at least one millimeter wave transmitting antenna positioned on said electrically conductive outer tube and electrically connected to said wave guide;
   - a millimeter wave received system comprising at least a mm-wave receiving antenna, a mixer and an IF-amplifier, said millimeter wave receiving system located on said electrically conductive outer tube for receiving millimeter waves and applying electrical signals to said coaxial conductor.

2. End-fed rod antenna in accordance with claim 1, wherein:
   - said wave guide is a circular waveguide.

3. End-fed rod antenna in accordance with claim 2 wherein:
   - said circular waveguide is sized to support $H_{01}$ waves.

4. End-fed rod antenna in accordance with claim 1 wherein:
   - the end-fed rod antenna has a base and a top at opposite ends of the end-fed antenna; and
   - said millimeter-wave transmitting antenna is located at said top and that at least one millimeter-wave receiving system is located between said millimeter transmitting antenna and base.

5. An end-fed rod antenna in accordance with claim 1, further comprising:
   - transmitter-receiver electronic assemblies electrically connected to said wave guide and said coaxial conductor, for propagating millimeter waves into said wave guide, for broadcasting via said millimeter wave transmitting antenna, and for receiving from said millimeter wave receiving antenna on said coaxial conductor.

6. End-fed rod antenna in accordance with claim 1 wherein:

at least one of said millimeter-wave transmitting and/or millimeter-wave receiving antenna has a range of transmission and/or reception of approximately 360° in the azimuth and an elevation of approximately 135°.

7. End-fed rod antenna in accordance with claim 1, wherein:

said outer tube is designed as an antenna for the VHF frequency range.

8. An end-fed rod antenna in accordance with claim 1, further comprising:

a mixer frequency wave located in said wave guide;

said mixer coupled to said millimeter wave receiving antenna and to said wave guide for forming an intermediate frequency signal from said mixer frequency wave in said wave guide and said millimeter wave receiving antenna, whereby said intermediate frequency signal is coupled through said coaxial conductor.

9. An end-fed rod antenna in accordance with claim 8, further comprising:

an additional intermediate frequency amplifier for amplifying said intermediate frequency signal, after being formed by said mixer and before being sent through said coaxial conductor.

10. An end-fed rod antenna in accordance with claim 1, wherein:

said millimeter-wave transmitting and receiving antenna are sized to support millimeter waves in a 60-GHz frequency range.

11. An end-fed rod antenna in accordance with claim 9 further comprising:

transmitter-receiver electronic assemblies electrically connected to said wave guide and said coaxial conductor, for propagating millimeter waves into said wave guide to be broadcasted via said millimeter wave transmitting antenna, and for receiving said intermediate frequency from said millimeter wave receiving antenna on said coaxial conductor; and said outer tube is an antenna for a VHF frequency range.

* * * * *